US009860950B2

(12) United States Patent
Kung et al.

(10) Patent No.: US 9,860,950 B2
(45) Date of Patent: Jan. 2, 2018

(54) DIMMING CONTROL METHOD AND CIRCUIT THEREOF

(71) Applicant: INDUSTRIAL TECHNOLOGY RESEARCH INSTITUTE, Hsinchu Hsien (TW)

(72) Inventors: Che-Min Kung, Hsinchu (TW); Tse-Hsu Wu, Hsinchu (TW); Jung-Min Hwang, Hsinchu (TW); Shun-Yi Yang, Hsinchu (TW)

(73) Assignee: INDUSTRIAL TECHNOLOGY RESEARCH INSTITUTE, Hsinchu Hsien (TW)

( * ) Notice: Subject to any disclaimer, the term of this patent is extended or adjusted under 35 U.S.C. 154(b) by 0 days.

(21) Appl. No.: 14/983,947

(22) Filed: Dec. 30, 2015

(65) Prior Publication Data

US 2017/0135170 A1 May 11, 2017

(30) Foreign Application Priority Data

Nov. 5, 2015 (TW) ..... 104136462 A

(51) Int. Cl.
*H05B 37/02* (2006.01)
*H05B 33/08* (2006.01)

(52) U.S. Cl.
CPC ..... *H05B 33/0845* (2013.01); *H05B 33/0809* (2013.01); *H05B 33/083* (2013.01)

(58) Field of Classification Search
CPC ..... H05B 37/02
USPC ..... 315/291, 308, DIG. 4, 194
See application file for complete search history.

(56) References Cited

U.S. PATENT DOCUMENTS 8,102,167 B2 * 1/2012 Irissou ..... H05B 39/02 315/194
8,723,431 B2 5/2014 Deppe et al.
8,736,194 B2 5/2014 Kawai et al.
8,796,940 B2 * 8/2014 Altonen ..... H01H 13/023 315/131
8,884,537 B2 11/2014 Liao et al.
2010/0283391 A1 * 11/2010 Braunshtein ..... H05B 37/0263 315/127

(Continued)

FOREIGN PATENT DOCUMENTS

CN 1578574 2/2005
TW M381241 5/2010

(Continued)

OTHER PUBLICATIONS

E-CMOS, "Dummy Load for LED Bulb with Triac.", EC4512 Datasheet, NA, 7 pages.

(Continued)

*Primary Examiner* — Thuy Vinh Tran
(74) *Attorney, Agent, or Firm* — Amin, Turocy & Watson LLP

(57) ABSTRACT

A dimming control method and circuit thereof are provided. After receiving a TRIAC signal with at least one positive/negative half cycle waveforms, the turning points of the positive/negative half cycles are detected to obtain the conduction angles of the positive/negative half cycle waveforms. Then, a pulse width modulated signal with the symmetrical positive and negative half cycle waveforms is rebuilt to control a lamp. Therefore, the disclosure can solve the flickering issue of the lamp.

11 Claims, 4 Drawing Sheets

(56) References Cited

U.S. PATENT DOCUMENTS

| | | | | |
|---|---|---|---|---|
| 2012/0098505 | A1* | 4/2012 | Irissou | H05B 39/08 323/237 |
| 2013/0181624 | A1 | 7/2013 | Kang | |
| 2014/0125239 | A1 | 5/2014 | Sullivan et al. | |

FOREIGN PATENT DOCUMENTS

| | | |
|---|---|---|
| TW | 201110821 | 3/2011 |
| TW | 201208470 | 2/2012 |
| TW | 201240523 | 10/2012 |
| TW | 201328432 | 7/2013 |
| TW | I412298 | 10/2013 |

OTHER PUBLICATIONS

Texas Instruments, "LM3445/48 Phase Dimming Work Book", Datasheet May 20, 2011 Revision, 65 pages.
Fairchild Semiconductor, "Design Guide for Triac Dimmable LED Driver Using FL7730", AN-9745 Datasheet, Oct. 11, 2012, 11 pages.
Stortz, et al. "EE362L, Power Electronics Triac Light Dimmer", Feb. 2, 2005, 5 pages.
Rand, et al. "Issues, Models and Solutions for Triac Modulated Phase Dimming of LED Lamps", IEEE 2007, pp. 1398-1404.
Taiwanese Office Action for Taiwanese Patent Application No. 104136462 dated Jun. 27, 2016.

* cited by examiner

DIMMING CONTROL METHOD AND CIRCUIT THEREOF

CROSS-REFERENCE TO RELATED APPLICATION

The present disclosure is based on, and claims priority from Taiwan Application Serial Number 104136462, filed on Nov. 5, 2015, the disclosure of which is hereby incorporated by reference herein in its entirety.

TECHNICAL FIELD

The present disclosure relates to a dimming control method and circuit thereof, and more particularly, to a dimming control method and circuit thereof for an LED lamp using a Triode for Alternating Current (TRIAC).

BACKGROUND

Existing dimmable LED lamps commonly use Triodes for Alternating Current (TRIACs) for dimming control. A Diode for Alternating Current (DIAC) is used in a TRIAC dimming control circuit to control the on and off cycles of the TRIAC.

However, due to the element characteristics of the DIAC, there is a deviation of about 3V between the breakover voltages of the positive and negative half cycles. As a result, the conduction angles of positive and negative half cycles of a TRIAC signal can be different. In other words, the positive and negative half cycle waveforms of the TRIAC signal are not symmetrical. This may cause variations in the brightness (i.e. flickering) of the LED lamp in a full cycle.

SUMMARY

One embodiment of the present disclosure is to provide a dimming control method, which may include the following steps of: receiving a triode for alternating current (TRIAC) signal with at least one positive half cycle waveform; detecting turning points of the positive half cycle to obtain a conduction angle of the positive half cycle waveform; and rebuilding a pulse width modulated (PWM) signal with symmetrical positive and negative half cycle waveforms based on the positive half cycle waveform and the conduction angle.

Another embodiment of the present disclosure is to provide a dimming control circuit, which may include: an electrical potential detecting unit for detecting turning points of a waveform of a triode for alternating current (TRIAC) signal, wherein the TRIAC signal includes at least one positive half cycle waveform; and a microprocessing unit. The microprocessing unit may include: a calculating module for calculating a conduction angle of the positive half cycle waveform based on the turning points; and a pulse width modulated (PWM) module for rebuilding a PWM signal with symmetrical positive and negative half cycle waveforms based on the positive half cycle waveform and the conduction angle thereof.

Still another embodiment of the present disclosure is to provide a dimming control method, which may include the following steps of: obtaining a conduction angle of a control signal with positive/negative half cycle waveforms; and rebuilding a pulse width modulated (PWM) signal with symmetrical positive and negative half cycle waveforms based on the positive/negative half cycle waveforms and the conduction angle.

Yet another embodiment of the present disclosure is to provide a dimming control circuit, which may include: a microprocessing unit, including a pulse width modulated (PWM) module for rebuilding a PWM signal with symmetrical positive and negative half cycle waveforms based on a conduction angle of a control signal with positive/negative half cycle waveforms and the positive/negative half cycle waveforms.

DETAILED DESCRIPTION

Figure 1:
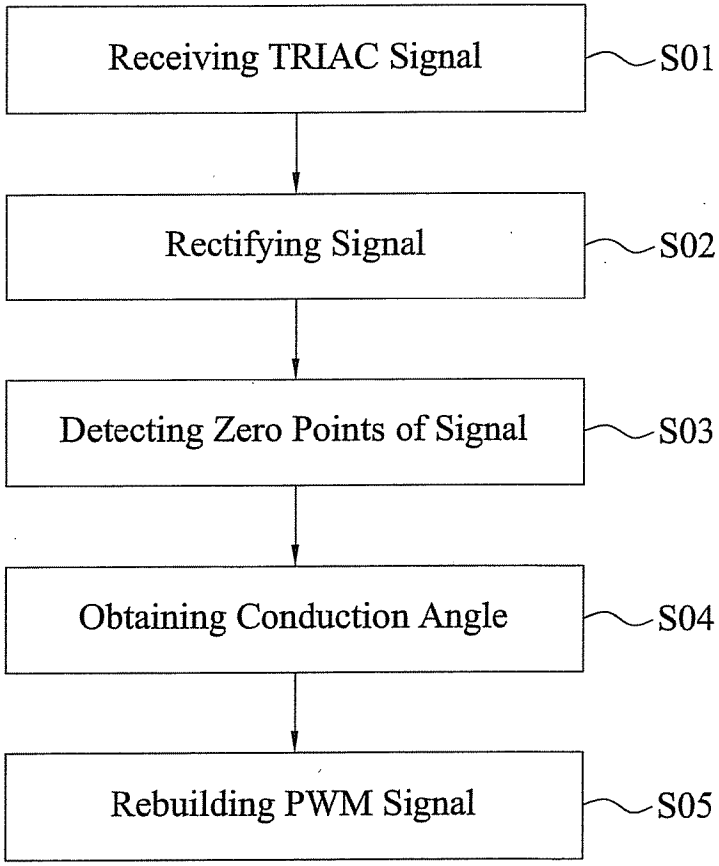
FIG. 1 is a flowchart illustrating the steps of a dimming control method in accordance with an exemplary embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Referring to FIG. 1, a dimming control method applicable to an LED lamp using a Triode for Alternating Current (TRIAC) in accordance with the present disclosure is shown. First, in step S01, a TRIAC signal is obtained, wherein the TRIAC signal has at least one positive half cycle waveform and at least one negative half cycle waveform. In one embodiment, the TRIAC signal is received from a rotary dimmer or a wireless control signal of a mobile phone, while the present disclosure is not limited thereto. The step S01 is then followed by step S02.

In step S02, after the TRIAC signal is received, the TRIAC signal is rectified. By rectification, the negative half cycle waveform is converted into a rectified positive half cycle waveform, that is, the negative half cycle waveform is turned correspondingly into positive values. The step S02 is then followed by step S03.

In step S03, the TRIAC signal is detected. More particularly, the positive half cycle waveform and the aforementioned rectified positive half cycle waveform of the TRIAC signal are detected. The detection includes finding the location at which the electrical potential of the positive half cycle waveform changes from 0 to 1 (hereinafter referring to turning point 1); the location at which the electrical potential of the rectified positive half cycle waveform changes from 0 to 1 (hereinafter referring to turning point 2); and the location at which the electrical potential of the positive half cycle waveform changes from 1 to 0 (hereinafter referring to turning point 3). In one embodiment, the detection is not limited to just once, in fact, the detection may be repeated several times to determine if noise is present. Thereafter, the turning points as described above can then be found. The step S03 is then followed by step S04.

In step S04, the conduction angle of the positive half cycle waveform can be determined from the turning points 1 to 3. For example, the duty cycle of the signal can be determined based on the turning points 1 and 2, and the duty ratio can be determined based on the turning points 1 and 3. As such, the conduction angle can be calculated. Then, the step S04 is followed by step S05.

In step S05, a new pulse width modulated (PWM) signal is rebuilt based on the positive half cycle waveform and the conduction angle thereof. Rebuilding means that each negative half cycle waveform symmetrical to the corresponding particular positive half cycle waveform is replicated based on the positive half cycle waveform and the conduction angle thereof, and the new PWM signal is constructed by alternately lining the positive half cycle waveform and the corresponding negative half cycle waveform. As a result, the positive and negative half cycles will be symmetrical in the new PWM signal. Afterward, the new PWM signal is used to control an optical coupler and a TRIAC circuit so as to control the lamp. Since the positive and negative half cycles are symmetrical in the new PWM signal, there would be no variations in the brightness (i.e. flickering) of the LED lamp in a full cycle.

Figure 2:
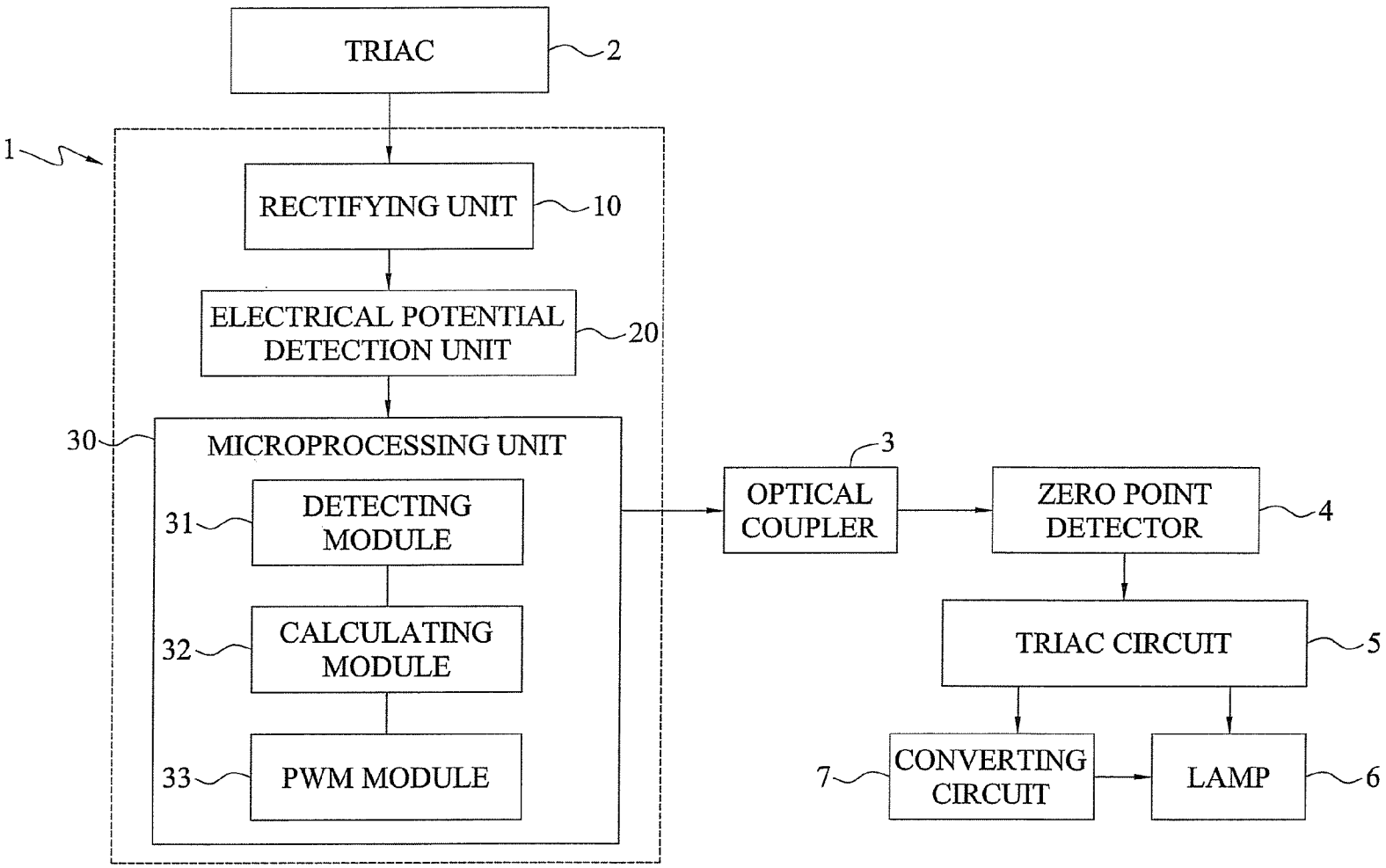
FIG. 2 is a schematic block diagram depicting a dimming control circuit in accordance with an exemplary embodiment.

Referring to FIG. 2, a dimming control circuit 1 in accordance with an embodiment is provided. The dimming control circuit 1 includes a rectifying unit 10, an electrical potential detection unit 20 and a microprocessing unit 30. In one embodiment, the electrical potential detection unit 20 is a zero point detector, the rectifying unit 10 is a bridge rectifier, and the microprocessing unit 30 is a microprocessor.

The dimming control circuit 1 receives a signal from a TRIAC 2, and sends the signal to the rectifying unit 10. The TRIAC signal includes at least one positive half cycle waveform and at least one negative half cycle waveform, and the rectifying unit 10 is used for rectifying the negative half cycle waveform into a rectified positive half cycle waveform. Subsequently, the positive half cycle waveform and the rectified positive half cycle waveform are sent to the electrical potential detection unit 20. The electrical potential detection unit 20 detects the turning points in the signal waveforms. The details of the detection have already been described above, and thus will not be repeated herewith.

The microprocessing unit 30 includes a detecting module 31, a calculating module 32 and a PWM module 33. The modules described herein refer to software or firmware executed by the microprocessing unit 30.

The detecting module 31 determines if the electrical potential detection unit 20 completes the detection, and if so, an interrupt program of the microprocessing unit 30 is activated so as to execute the functions of the calculating module 32 and the PWM module 33.

The calculating module 32 is used for calculating the conduction angle of the positive half cycle waveform based on the turning points of the signal waveforms detected by the electrical potential detection unit 20. The conduction angle of the positive half cycle waveform is determined by the zero potentials of the positive half cycle waveform and the rectified positive half cycle waveform. The PWM module 33 is used for rebuilding a PWM signal with symmetrical positive and negative half cycles waveforms based on the positive half cycle waveform and the conduction angle thereof. The details of the rebuilding have been described earlier, and thus will not be repeated again.

The PWM signal with symmetrical positive and negative half cycle waveforms thus generated in the dimming control circuit 1 in accordance with an embodiment can be inputted into an optical coupler 3 and a zero point detector 4. The zero point detector 4 synchronizes the PWM signal and the AC signal, and the resulting signal is then inputted into a TRIAC circuit 5. The TRIAC circuit 5 can output a TRIAC signal to control a lamp 6.

In another embodiment, the dimming control circuit 1 can be further connected to a converting circuit 7, in addition to the optical coupler 3, the zero point detector 4 and the TRIAC circuit 5. The converting circuit 7 is used for converting the output signal of the TRIAC circuit 5 into a PWM signal or a DC signal (e.g. 1-10 V) to control various types of lamps.

In one embodiment, the dimming control circuit 1 in accordance is connected to the back end of a TRIAC 2 (i.e. at the back end of a commercially available TRIAC dimmer including a DIAC element). Through the dimming control circuit 1 according to an embodiment, a TRIAC signal originally generated by the TRIAC dimmer can be modified into a PWM signal with symmetrical positive and negative half cycle waveforms, such that the flickering issue of a LED lamp in a full cycle can be reduced.

Figure 3:
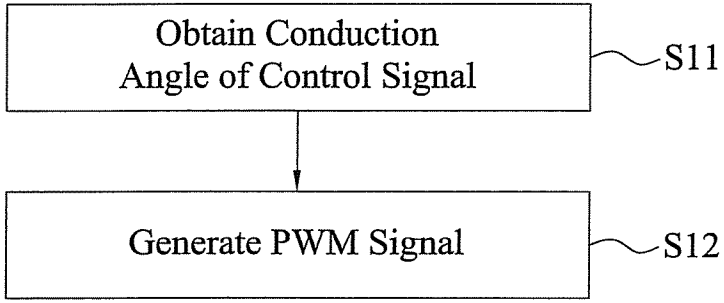
FIG. 3 is a flowchart illustrating the steps of another dimming control method in accordance with an exemplary embodiment.
Figure 4:
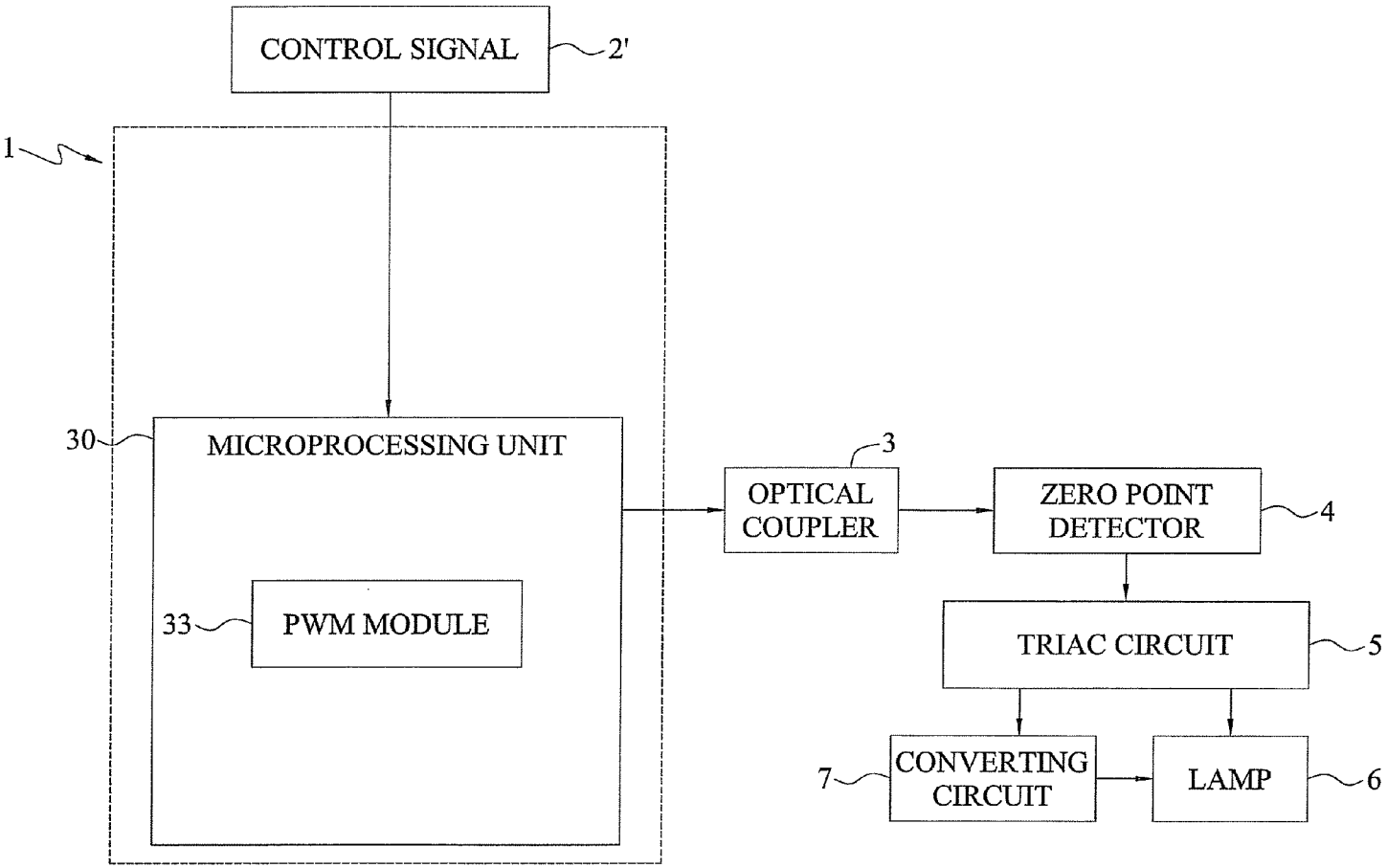
FIG. 4 is a schematic block diagram depicting another dimming control circuit in accordance with an exemplary embodiment

In another embodiment, as shown in FIGS. 3 and 4, the dimming control circuit 1 may replace the DIAC element in a traditional TRIAC dimmer, and directly output a PWM signal with symmetrical positive and negative half cycle waveforms. The embodiment shown in FIGS. 3 and 4 is described below, whereas technical contents similar or identical to previous embodiments will not be repeated herewith.

As shown in FIG. 3, in step S11, the conduction angle of a control signal having positive/negative half cycle waveforms is obtained. The control signal may be received from a rotary dimmer or a wireless control signal of a mobile phone. The step S11 is then followed by step S12.

In step S12, a PWM signal with symmetrical positive and negative half cycle waveforms is rebuilt based on the positive/negative half cycle waveforms and the conduction angle. The details of rebuilding have already been described above, and will not be repeated herewith.

As shown in FIG. 4, the dimming control circuit 1 in accordance with an embodiment includes a microprocessing unit 30. The microprocessing unit 30 includes a PWM module 33 which rebuilds a PWM signal with symmetrical positive and negative half cycle waveforms based on the conduction angle of the control signal 2' having positive/negative half cycle waveforms and the positive/negative half cycle waveforms.

In one embodiment, the control signal 2' is received from a rotary dimmer or a wireless control signal of a mobile phone. In another embodiment, the dimming control circuit 1 can be further connected to an optical coupler 3, a zero point detector 4, a TRIAC circuit 5, and a converting circuit 7 in order to control a lamp 6. Relevant technical contents have already been described above, and will not be repeated herewith.

In summary, the dimming control circuit and the dimming control method described above are capable of modifying a signal with non-symmetrical positive/negative half cycle waveforms received from a DIAC element into a PWM signal with symmetrical positive/negative half cycle waveforms, or capable of directly outputting a PWM signal with symmetrical positive/negative half cycle waveforms. As such, the difference in the conduction angles of the positive and negative half cycles of the TRIAC signal due to the element characteristics of the DIAC can be eliminated, and the flickering in the lamp can be in turns reduced. The dimming control circuit in this disclosure is suitable for high efficiency switching architecture (such as PWM) and low cost linear architecture (such as TRIAC modulation) without the need of dedicated driver IC.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A dimming control circuit, comprising:

an electrical potential detecting unit configured to detect turning points of a waveform of a triode for alternating current (TRIAC) signal, wherein the TRIAC signal includes at least one positive half cycle waveform;

a microprocessing unit including:

a calculating module configured to calculate a conduction angle of the at least one positive half cycle waveform based on the turning points; and a pulse width modulated (PWM) module configured to rebuild a PWM signal with symmetrical positive and negative half cycle waveforms based on the at least one positive half cycle waveform and the conduction angle of the at least one positive half cycle waveform; and an optical coupler and a zero point detector, wherein the zero point detector synchronizes the PWM signal with an alternating current (AC) signal, such that a synchronized signal is inputted into a TRIAC circuit for outputting a signal that controls a lamp.

2. The dimming control circuit of claim 1, wherein the TRIAC signal further includes at least one negative half cycle waveform.

3. The dimming control circuit of claim 2, further comprising a rectifying unit configured to rectify the at least one negative half cycle waveform into at least one rectified positive half cycle waveform.

4. The dimming control circuit of claim 3, wherein the conduction angle of the at least one positive half cycle waveform is determined based on zero potentials of the at least one positive half cycle waveform and the at least one rectified positive half cycle waveform.

5. The dimming control circuit of claim 3, wherein the rectifying unit is a bridge rectifier.

6. The dimming control circuit of claim 1, wherein the electrical potential detecting unit is a zero point detector.

7. The dimming control circuit of claim 1, further comprising a converting circuit configured to convert the output signal of the TRIAC circuit into the PWM signal or a direct current (DC) signal for controlling the lamp.

8. The dimming control circuit of claim 1, wherein the microprocessing unit further comprises a detecting module configured to determine if the electrical potential detecting unit completes a detection, and if so, an interrupt program of the microprocessing unit is activated.

9. A dimming control circuit, comprising:

a microprocessing unit including a pulse width modulated (PWM) module configured to rebuild a PWM signal with symmetrical positive and negative half cycle waveforms based on a conduction angle of a control signal with positive or negative half cycle waveforms; and an optical coupler and a zero point detector, wherein the zero point detector synchronizes the PWM signal with an alternating current (AC) signal, such that a synchronized signal is inputted into a TRIAC circuit for outputting a signal that controls a lamp.

10. The dimming control circuit of claim 9, wherein the control signal is received from a rotary dimmer or a wireless control signal of a mobile phone.

11. The dimming control circuit of claim 9, further comprising a converting circuit configured to convert the output signal of the TRIAC circuit into the PWM signal or a direct current (DC) signal for controlling the lamp.

* * * * *